US009632467B2

(12) United States Patent
Tanaka

(10) Patent No.: US 9,632,467 B2
(45) Date of Patent: Apr. 25, 2017

(54) FIXING DEVICE

(71) Applicant: CANON KABUSHIKI KAISHA, Tokyo (JP)

(72) Inventor: Masaki Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/160,138

(22) Filed: May 20, 2016

(65) Prior Publication Data

US 2016/0349684 A1 Dec. 1, 2016

(30) Foreign Application Priority Data

May 28, 2015 (JP) ..... 2015-108318

(51) Int. Cl.
*G03G 15/20* (2006.01)

(52) U.S. Cl.
CPC ..... *G03G 15/2089* (2013.01); *G03G 15/2067* (2013.01)

(58) Field of Classification Search
CPC ..... G03G 15/2089; G03G 15/2067
USPC ..... 399/329
See application file for complete search history.

(56) References Cited

U.S. PATENT DOCUMENTS

| | | | | |
|---|---|---|---|---|
| 7,773,253 | B2 | 8/2010 | Katayanagi | |
| 8,626,018 | B2 * | 1/2014 | Ogawa | G03G 15/6576 399/122 |
| 9,229,429 | B2 | 1/2016 | Akatsuka et al. | |
| 2006/0028671 | A1 | 2/2006 | Katayanagi | |
| 2015/0093164 | A1 | 4/2015 | Tanaka et al. | |

FOREIGN PATENT DOCUMENTS

| | | | |
|---|---|---|---|
| JP | 2006047739 | A | 2/2006 |
| JP | 2008081228 | A | 4/2008 |
| JP | 2009294331 | A | 12/2009 |
| JP | 2011180209 | A | 9/2011 |

* cited by examiner

*Primary Examiner* — Susan Lee
(74) *Attorney, Agent, or Firm* — Fitzpatrick, Cella, Harper & Scinto

(57) ABSTRACT

A fixing device includes a fixing roller; a heating unit, a pressing unit, a force imparting mechanism, a first pressure releasing mechanism including a first cam portion actable on the force imparting mechanism and a first gear portion for driving the first cam portion; and a second pressure releasing mechanism including a second cam portion actable on the force imparting mechanism and a second gear portion for driving the second cam portion. The first gear portion and the second gear portion engage with each other, and a driving force is transmitted from one gear portion of the first and second gear portions to the other gear portion.

7 Claims, 12 Drawing Sheets

(a)

(b)

FIXING DEVICE

FIELD OF THE INVENTION AND RELATED ART

The present invention relates to a fixing device for heating and fixing a toner image on a recording material (medium). This fixing device is usable in an image forming apparatus, represented by for example a copying machine, a printer, a facsimile machine or a multi-function machine of these machines, employing an electrophotographic process, an electrostatic recording process or the like.

An image forming apparatus in which in order to improve a jam clearance property in the fixing device and to prevent deformation of a shape of a part (component) in the fixing device, a pressure-releasing mechanism for releasing a pressure exerted on a fixing nip is provided has become widespread.

Further, a fixing device of an externally heating type in which a fixing roller, a heating unit for forming a heating nip in press-contact with the fixing roller, and a pressing unit for forming a fixing nip in press-contact with the fixing roller are provided has been known. In the fixing device of this type, the heating unit heats the fixing roller at the heating nip and an unfixed image formed on the recording material is fixed at the fixing nip. Therefore, this device has such a structure that there are two nips with respect to a circumferential direction of the fixing roller. When such a jam that the recording material is wound about the fixing roller is taken into consideration, it is preferable that both of the two nips are constituted so as to be capable of being pressure-released. Further, it is preferable that the two nips are constituted so that the two nips can be pressure-released simultaneously or with a predetermined time difference.

SUMMARY OF THE INVENTION

The present invention has been accomplished in view of the above-described problem. A principal object of the present invention is to provide a fixing device having a constitution capable of effecting pressure-release of two nips simultaneously or a constitution capable of effecting the pressure-release of the two nips with a predetermined time difference.

According to an aspect of the present invention, there is provided a fixing device comprising: a fixing roller; a heating unit for forming a heating nip in cooperation with the fixing roller; a pressing unit for forming a fixing nip in cooperation with the fixing roller; a force imparting mechanism for imparting a force to the heating unit and the pressing unit in directions of sandwiching the fixing roller; a first pressure releasing mechanism including a first cam portion actable on the force imparting mechanism in a direction of spacing the heating unit from the fixing roller and including a first gear portion for driving the first cam portion; and a second pressure releasing mechanism including a second cam portion actable on the force imparting mechanism in a direction of spacing the pressing unit from the fixing roller and including a second gear portion for driving the second cam portion, wherein the first gear portion and the second gear portion engage with each other, and a driving force is transmitted from one gear portion of the first and second gear portions to the other gear portion.

Further features of the present invention will become apparent from the following description of exemplary embodiments with reference to the attached drawings.

DESCRIPTION OF THE EMBODIMENTS

In the following, with reference to the drawings, embodiments for carrying out the present invention will be exemplarily described based on specific embodiments.

Embodiment 1

Image Forming Apparatus

Figure 2:
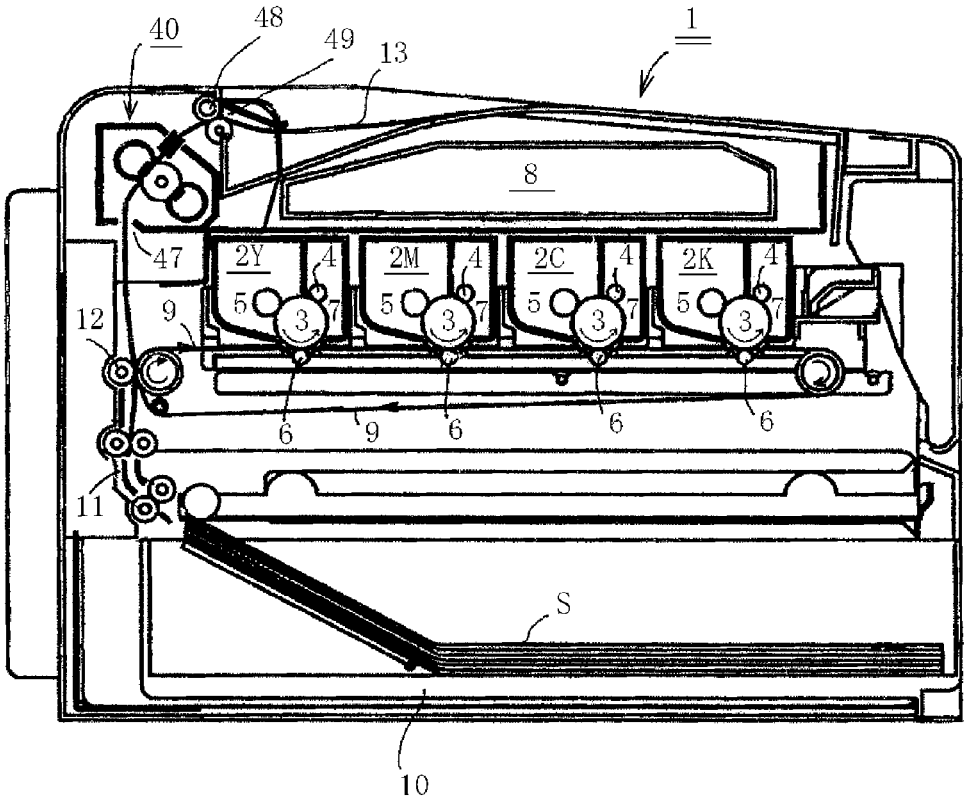
FIG. 2 is a schematic structural view of an example of an image forming apparatus.

FIG. 2 is a schematic structural view of an example (four-color based full-color laser printer in this embodiment) of an image forming apparatus 1 employing an electrophotographic process. This image forming apparatus 1 includes four image forming portions 2 (2Y, 2M, 2C, 2K) for forming toner images of yellow (Y), magenta (M), cyan (C), and black (K), respectively. Each of the image forming portions 2 includes a photosensitive drum 3, a charging roller 4, a developing device 5, a primary transfer roller 6 and a cleaning device 7.

Further, the image forming apparatus 1 includes a laser scanner unit 8 for subjecting each photosensitive drum 3 to scanning exposure and an endless belt (intermediary transfer belt) 9 onto which the toner images of Y, M, C, K formed on the respective photosensitive drums 3 are to be primary-transferred. Further, the image forming apparatus 1 includes a secondary transfer roller 12 for secondary-transferring the toner images from the belt 9 onto a recording material (hereinafter referred to as a sheet) S. Further, the image forming apparatus 1 includes a cassette 10 for accommodating sheets and a sheet feeding mechanism 11 for feeding the sheet S to a secondary transfer portion formed by the belt 9 and the secondary transfer roller 12.

The sheet S on which unfixed toner images are transferred from the belt 9 at the secondary transfer portion is sent to a fixing device 40 in which the toner images are fixed on the recording material S, and then the recording material S is discharged onto a tray 13. The above-constituted image forming apparatus, an image forming operation and an image forming process are well known and therefore details thereof will be omitted.

<Fixing Device>

Figure 3:
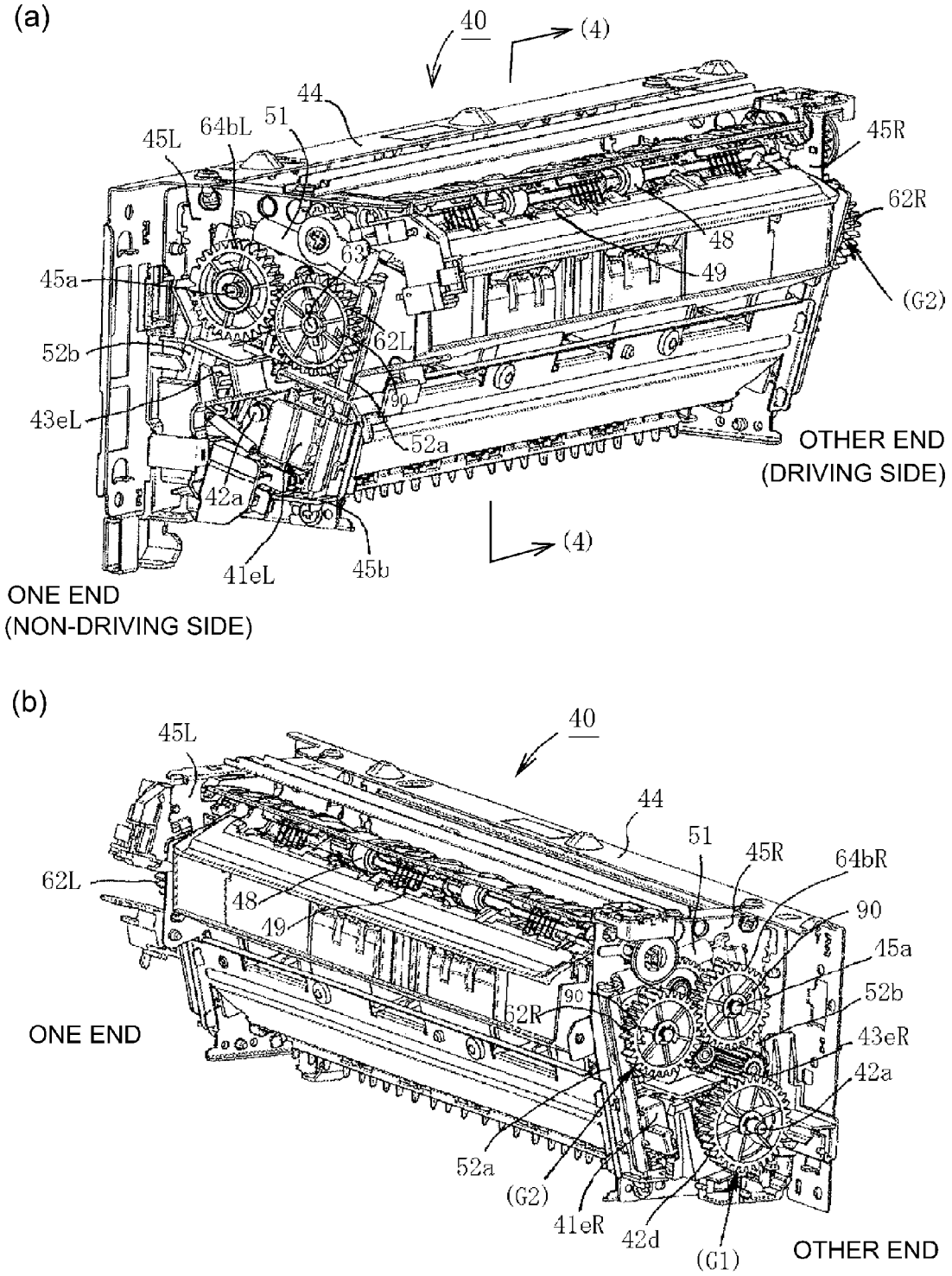
In FIG. 3, (a) is a perspective view of a fixing device as seen from one end side, and (b) is a perspective view of the fixing device as seen from the other end side.
Figure 4:
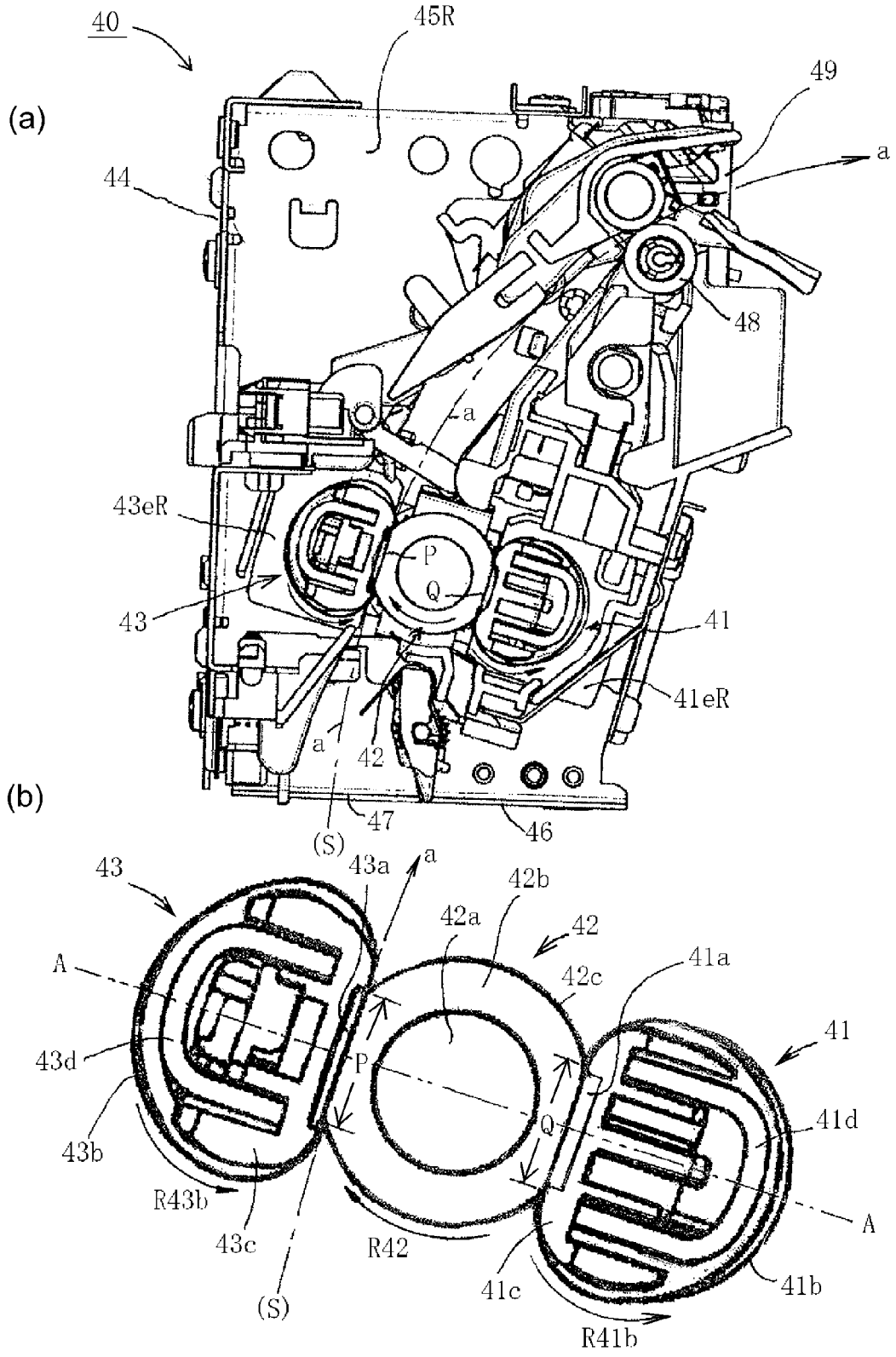
In FIG. 4, (a) is a cross-sectional view of the fixing device, and (b) is a partly enlarged view of (a) (of FIG. 4).

With reference to FIGS. 3 and 4, a general structure and an operation of the fixing device 40 in this embodiment will be described. In FIG. 3, (a) is a perspective view of the fixing device 40 as seen from one end side (non-driving side) with respect to a longitudinal direction, and (b) is a perspective view of the fixing device 40 as seen from the other end side (driving side) with respect to the longitudinal direction. In FIG. 4, (a) is a cross-sectional view of the fixing device 40 taken along (4)-(4) line in (a) of FIG. 3, and (b) is a partly enlarged view of (a) of FIG. 4.

The fixing device 40 includes a fixing roller 42, a pressing unit 43 for forming a fixing nip P between itself and the fixing roller 42, a heating unit 41 for forming a heating nip Q between itself and the fixing roller 42, and a casing 44 (frame: device main assembly) accommodating these members. The pressing unit 43 and the heating unit 41 are disposed in parallel with the fixing roller 42 so as to sandwich the fixing roller 42 therebetween.

(1) Fixing Roller

The fixing roller 42 is constituted by a core metal portion 42*a*, an elastic layer (rubber layer) 42*b* provided on an outer peripheral surface of the core metal portion 42*a*, and a surface layer 42*c* provided on an outer peripheral surface of the elastic layer 42*b*. This fixing roller 42 is rotatably supported at both end portions of the core metal portion 42*a* by side plates 45L, 45R on one end side and the other end side, respectively, with respect to the longitudinal direction of the casing 44 via bearing members (not shown).

Figure 12:
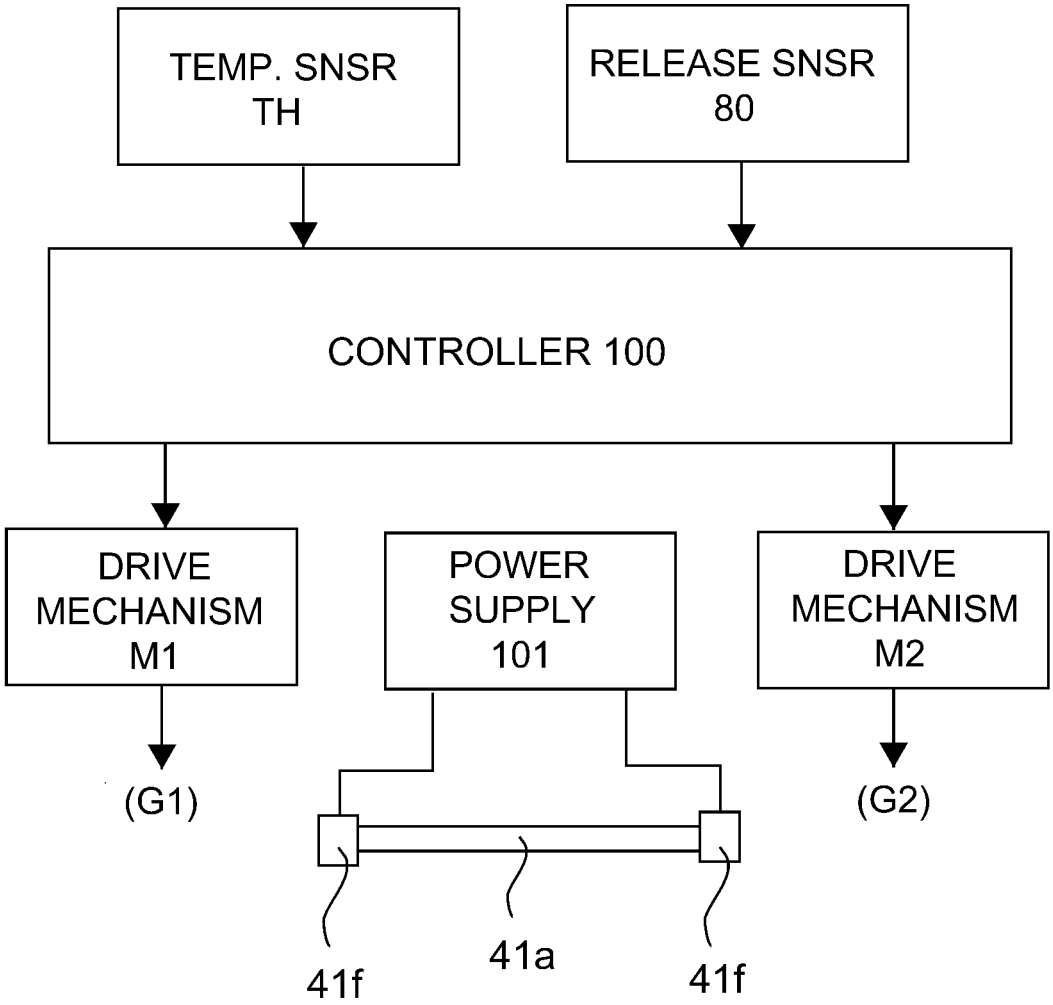
FIG. 12 is a block diagram of a control system.

At an end portion of the core metal portion 42*a* on the other end side, a gear 42*d* is mounted concentrically integral with the core metal portion 42*a*. With this gear 42*d*, a first main assembly gear G1 (not shown) on an image forming apparatus main assembly side engages. The first main assembly gear G1 is driven by a driving mechanism M1 controlled by a controller 100 (FIG. 12) and transmits a driving force to the gear 42*d*. As a result, the fixing roller 42 is rotationally driven in an arrow R42 direction at a predetermined process speed.

(2) Heating Unit

The heating unit 41 is a heating member (external heating type) for heating the fixing roller 42 from an outside. The heating unit 41 includes a heat generating member 41*a*, a holder 41*c* for holding the heat generating member 41*a*, a rigid stay 41*d*, and a film (belt) 41*b*, which has an endless shape and flexibility, loosely fitted around an assembly of these members. Each of the heat generating member 41*a*, the holder 41*c* and the stay 41*d* is a long member extending along the longitudinal direction of the fixing roller 42. The heat generating member 41*a* is an elongated flat plate-like member (ceramic heater) prepared by forming a heat generating resistor on a ceramic substrate.

On one end side and the other end side of the holder 41*c* and the stay 41*d*, guiding members 41*e*L, 41*e*R for guiding end portions of the film 41*b* are mounted, respectively. The guiding members 41*e*L, 41*e*R are mounted in groove portions (not shown) formed on the side plates 45L, 45R, respectively, of the casing 44 and are slidable (movable) in directions of moving toward and away from the fixing roller 42. That is, an entirety of the heating unit 41 is slidable in the directions of moving toward and away from the fixing roller 42.

Figure 5:
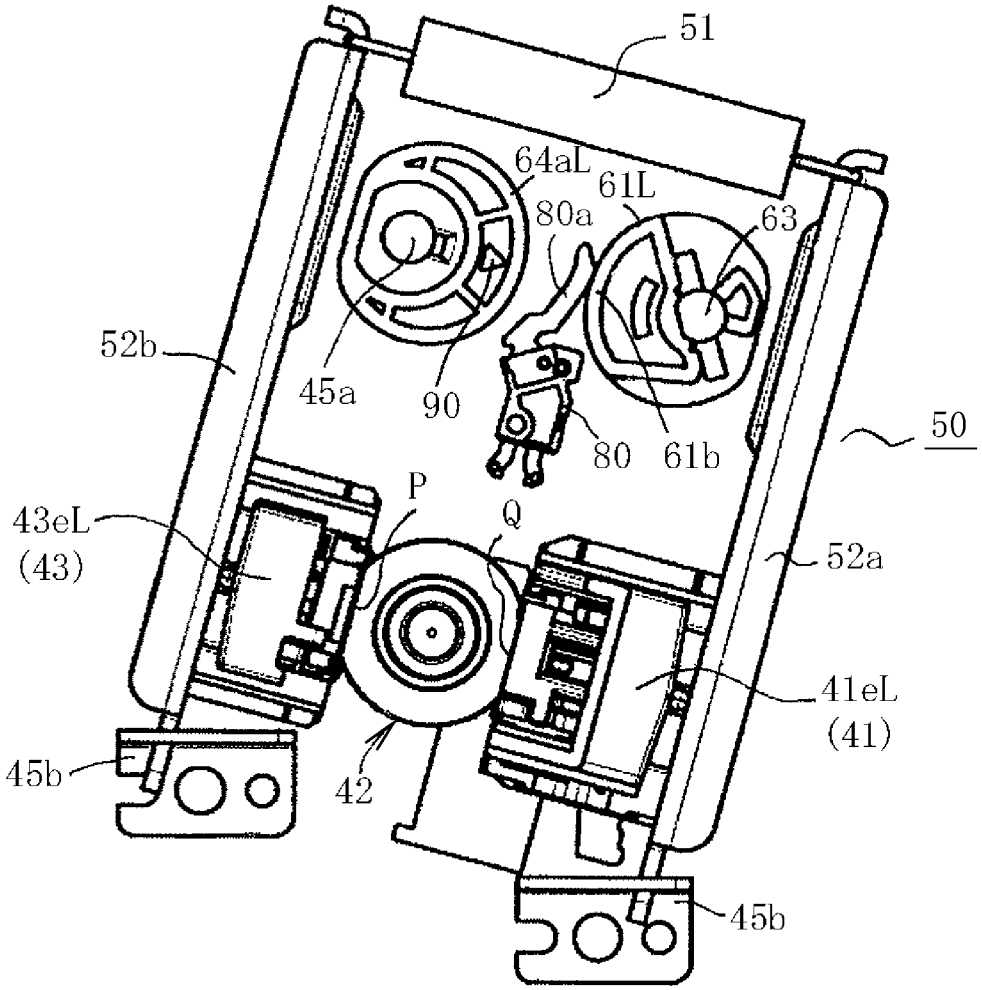
FIG. 5 is a schematic view showing the force imparting mechanism in a pressure-applied state on one end side.

Further, to each of the guiding members 41*e*L, 41*e*R, a predetermined pressure (urging force) is imparted (applied) by a force imparting mechanism 50 (FIG. 5). As a result, the heating unit 41 slides in a direction of being pressed against the fixing roller 42, so that the heat generating member 41*a* is press-contacted to the film 41*b* toward the fixing roller 42 against elasticity of the elastic layer 42*b*. By this press-contact, the heating nip Q having a predetermined width is formed between the film 41*b* and the fixing roller 42.

In a state in which the heating unit 41 is press-contacted to the fixing roller 42, the film 41*b* is rotated by rotational drive of the fixing roller 42. The film 41*b* rotates in an arrow R41*b* direction while sliding in close cam with a surface of the heat generating member 41*a* on an inner surface side in the heating nip Q. The film 41*b* is regulated by the guiding members 41*e*L, 41*e*R in terms of flexure with respect to a radial direction and movement in the longitudinal direction (direction parallel to a rotational axis direction of the fixing roller 42).

The heat generating member 41*a* generates heat by electric power supplied from an electric power supplying portion 101, controlled by the controller 100, to an electric power supplying connector 41*f*. Then, the surface of the rotationally driven fixing roller 42 is heated by heat generation of the heat generating member 41*a* through the film 41*b*. A surface temperature of the fixing roller 42 is detected by a temperature sensor TH and is fed back to the controller 100. The controller 100 controls the electric power supplied from the electric power supplying portion 101 to the heat generating member 41*a* so that a detection temperature of the temperature sensor TH is maintained at a predetermined temperature (temperature control).

(3) Dressing Unit

The pressing unit view 43 includes a sliding member 43*a*, a holder 43*c* for holding the sliding member 43*a*, a rigid stay 43*d*, and a film (belt) 43*b*, which has an endless shape and flexibility, loosely fitted around an assembly of these members. Each of the sliding member 43*a*, the holder 43*c* and the stay 43*d* is a long member extending along the longitudinal direction of the fixing roller 42. The sliding member 43*a* is an elongated flat plate-like member (ceramic heater) formed with a rigid member and is an aluminum plate in this embodiment.

On one end side and the other end side of the holder 43*c* and the stay 43*d*, guiding members 43*e*L, 43*e*R are mounted, respectively. The guiding members 43*e*L, 43*e*R are mounted in groove portions (not shown) formed on the side plates 45L, 45R, respectively, of the casing 44 and are slidable (movable) in directions of moving toward and away from the fixing roller 42. That is, an entirety of the pressing unit 43 is slidable in the directions of moving toward and away from the fixing roller 42.

Further, to each of the guiding members 43*e*L, 43*e*R, a predetermined pressure (urging force) is imparted (applied) by a force imparting mechanism 50. As a result, the pressing unit 43 slides in a direction of being pressed against the fixing roller 42, so that the sliding member 43*a* is press-contacted to the film 43*b* toward the fixing roller 42 against elasticity of the elastic layer 42*b*. By this press-contact, the fixing nip P having a predetermined width is formed between the film 43*b* and the fixing roller 42.

In a state in which the pressing unit 43 is press-contacted to the fixing roller 42, the film 43*b* is rotated by rotational drive of the fixing roller 42. The film 43*b* rotates in an arrow R43*b* direction while sliding in close cam with a surface of the sliding member 43*a* on an inner surface side in the fixing nip P. The film 43*b* is regulated by the guiding members 43*e*L, 43*e*R in terms of flexure with respect to a radial direction and movement in the longitudinal direction (direction parallel to a rotational axis direction of the fixing roller 42).

(4) Fixing Operation

In FIG. 3, each of (a) and (b) shows a state in which the heating unit 41 and the pressing unit 43 are pressed against the fixing roller 42 and thus the heating nip Q is formed between the heating unit 41 and the fixing roller 42 and the fixing nip P is formed between the pressing unit 43 and the fixing roller 42 and in which the fixing roller 42 is rotationally driven and is temperature-controlled by being heated to a predetermined surface temperature.

In this state, the sheet S carrying thereon the (unfixed) toner images is introduced into the fixing device 40. The sheet S is fed upwardly from the secondary transfer portion and enters an inside of the casing 44 through an entrance 47 of a bottom plate 46 of the casing 44 of the fixing device 40. Further, the sheet S enters the fixing nip P and is fed from below to above. As a result, the (unfixed) toner images superposed on the sheet S are fixed on the sheet S by heat of the fixing roller 42 and nip pressure.

The sheet S, which is fed through the fixing nip P from below to above and which is then discharged out of the fixing device 40, is relayed by a discharging roller pair 48 and is discharged onto a tray 13 through a discharge opening 49. In (a) of FIG. 4, a chain line represents a sheet feeding path a from the entrance 47 to the discharge opening 49 in the fixing device 40.

(5) Force Imparting Mechanism

The pressing unit 43 and the heating unit 41 are disposed so as to sandwich the fixing roller 42 with respect to a direction perpendicular to a rotation center axis of the fixing roller 42 as shown in FIG. 4. Further, the heating unit 41 and the pressing unit 43 are supported between the side plates 45L, 45R of the casing 44 so as to be slidable in a direction of sandwiching the fixing roller 42.

In the following, a direction in which the heating unit 41 and the pressing unit 43 are slidable is referred appropriately as a "slide direction A". Incidentally, this slide direction A and a direction in which a force by the force imparting mechanism 50 described below is imparted (applied) are parallel to each other. Further, in the fixing device 40 in this embodiment, the force is imparted to the pressing unit 43 and the heating unit 41 by the force imparting mechanism 50 with respect to the sandwiching direction of the fixing roller 42.

The force imparting mechanism 50 is provided outside each of the side plates 45L, 45R on one end side and the other end side of the casing 44. The force imparting mechanism 50 on one end side and the force imparting mechanism 50 on the other end side have the same constitution.

FIG. 5 shows the force imparting mechanism 50 provided on the side plate 45L on one end side. The force imparting mechanism 50 includes a pair of pressing plates 52*a*, 52*b*. Each of the pressing plates 52*a*, 52*b* is supported at a lower end portion thereof by a supporting member 45*b* mounted to the side plate 45L and is rotatable about the lower end portion. The pressing plate 52*a* has a function of pressing the guiding member 41*a*L on one end side of the heating unit 41. The pressing plate 52*b* has a function of pressing the guiding member 41*e*L on one end side of the pressing unit 43.

Upper end portions of the pressing plates 52*a*, 52*b* are connected with each other by a tension spring (pressing spring) 51. The pressing plates 52*a*, 52*b* are rotationally urged by a tensile force of the spring 51 in a direction in which the pressing plates 52*a*, 52*b* move toward each other with the lower end portions as fulcrums. For that reason, urging forces in opposite directions to each other are caused to act on the guiding member 41*e*L on one end side of the heating unit 41 and the guiding member 43*e*L on one end side of the pressing unit 43 by the pressing plates 52*a*, 52*b*, respectively (FIG. 5).

Similarly, urging forces in opposite directions to each other are caused to act on also the guiding member 41*e*R on the other end side of the heating unit 41 and the guiding member 43*e*R on the other end side of the pressing unit 43, respectively.

Accordingly, by the tensile forces of the springs 51 of the force imparting mechanisms 50 on one end side and the other end side described above, the forces are imparted to the pressing unit 43 and the heating unit 41 via the pressing plates 52*a*, 52*b* in the direction in which the fixing roller 42 is sandwiched and pressed.

By the thus-constituted force imparting mechanisms 50 on one end side and the other end side, the fixing roller 42 is pressed from both slides by the heating unit 41 and the pressing unit 43, so that the elastic layer 42*b* is compressedly deformed. In this manner, the heating nip Q is formed by the fixing roller 42 and the heating unit 41, and the fixing nip P is formed by the fixing roller 42 and the pressing unit 43.

(6) Pressure Releasing Mechanism

Figure 6:
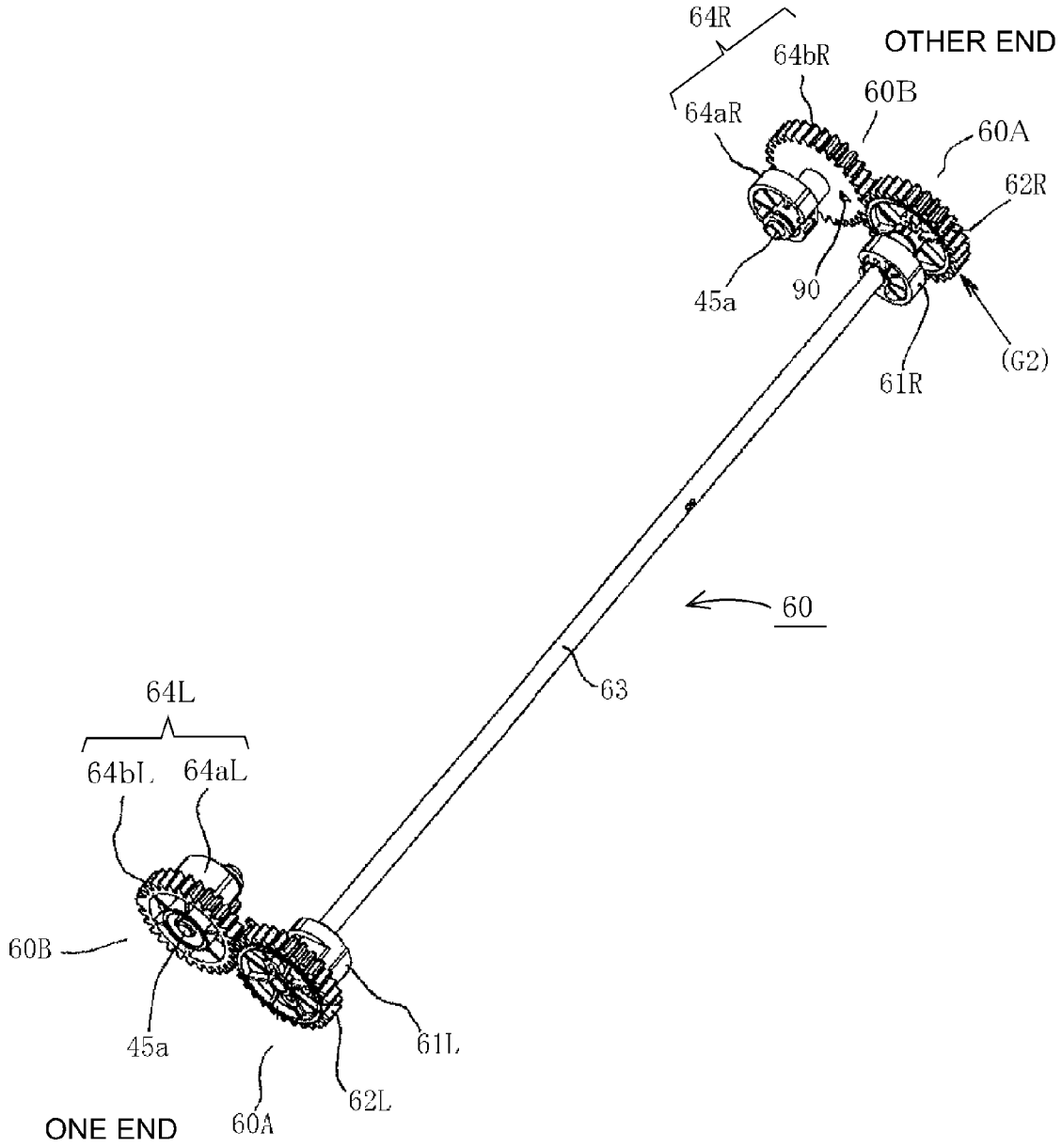
FIG. 6 is a perspective view of a pressure-releasing mechanism.

Next, a pressure-releasing mechanism 60 for releasing (eliminating) pressures of the above-described force imparting mechanisms 50 to the heating unit 41 and the pressing unit 43 will be described. FIG. 6 is a perspective view of a principal part of the pressure-releasing mechanism 60. The pressure-releasing mechanism 60 is constituted by a first pressure-releasing mechanism 60A actable on the force imparting mechanism 50 in a direction in which the heating unit 41 is spaced from the fixing roller 42 and a second pressure-releasing mechanism 60B actable on the force imparting mechanism 50 in a direction in which the pressing unit 43 is spaced from the fixing roller 42.

The first pressure-releasing mechanism 60A includes cams 61L, 61R (first cam portions), gears 62L, 62R (first gear portions) which are disposed outside the side plates 45L, 45R, respectively, and a pressure-releasing shaft 63 connecting the cams 61L, 61R and connecting the gears 62L, 62R. The cams 61L, 61R, the gears 62L, 62R and the shaft 63 are coaxially disposed and are rotated integrally with each other.

The second pressure-releasing mechanism 60B includes cam gears 64L, 64R which integrally include cams 64*a*L, 64*a*R (second cam portions) and gears 64*b*L, 64*b*R (second gear portions) which are disposed outside the side plates 45L, 45R, respectively. The cam gears 64L, 64R are disposed rotatably about caulking shafts 45*a* caulked with the side plates 45L, 45R, respectively.

The cam gears 64L, 64R rotate by drive transmission through engagement of the gears 64*b*L, 64*b*R with the gears 62L, 62R of the first pressure-releasing mechanism 60A on one end side and the other end side, respectively. The numbers of teeth of the gears 64*b*L, 64*b*R are the same as those of the gears 62L, 62R, respectively.

With the gear 62R of the first pressure-releasing mechanism 60A on the other end side, a second main assembly gear G2 (not shown) on the image forming apparatus main assembly side engages.

The second main assembly gear G2 is driven by a driving mechanism M2 (FIG. 12) controlled by the controller 100 and transmits a driving force to the gear 62R.

During printing of the image forming apparatus 1 or when the image forming apparatus 1 is in a stand-by state, the cams 61L, 61R of the pressure-releasing mechanism 60 and minimum outer diameter portions of the cams 64*a*L, 64*a*R of the cam gears 64L, 64R are directed toward the associated pressing plates 52*a*, 52*b* of the force imparting mechanisms 50, respectively. FIG. 5 shows this state of the fixing device 40 on one end side. This is true for also the other end side.

In this state, a gap (spacing) is provided between the cam 61L (61R) and the pressing plate 52*a* and between the cam 64*a*L (64*a*R) of the cam gear 64L (64R) and the pressing plate 52*b*. That is, the pressure-releasing mechanism 60 is in a non-actable state on the force imparting mechanisms 50 on one end side and the other end side. Accordingly, a pressing state in which the heating unit 41 and the pressing unit 43 press the fixing roller 42 by the force imparting mechanisms 50 on one end side and the other end side is formed.

In the case where a jam of the recording material generates during the printing, the controller 100 interrupts an image forming operation of the image forming apparatus 1. The controller 100 also stops drive of the fixing device 40. On the other hand, the controller 100 drives the driving mechanism M2. A driving force of this driving mechanism M2 is transmitted to the gear 62R of the pressure-releasing mechanism 60 via the second main assembly gear G2, so that the four gears 62R, 62*b*R, 62L, 62*b*L of the pressure-releasing mechanism 60 start rotation simultaneously in interrelation with each other. Also in the case where a non-printing time reaches a predetermined time and the image forming apparatus 1 goes to an energy saving mode, a similar operation is performed.

When the above-described rotation is started, sides where outer diameters of the cams 61L, 61R and the cams 64*a*L, 64*a*R are large gradually move toward the associated pressing plates 52*a*, 52*b* of the force imparting mechanisms 50 on one end side and the other end side, respectively. Then, these cams push the associated pressing plates 52*a*, 52*b* toward an opposite side to the pressing direction against the tensile force of the springs 51.

Figure 7:
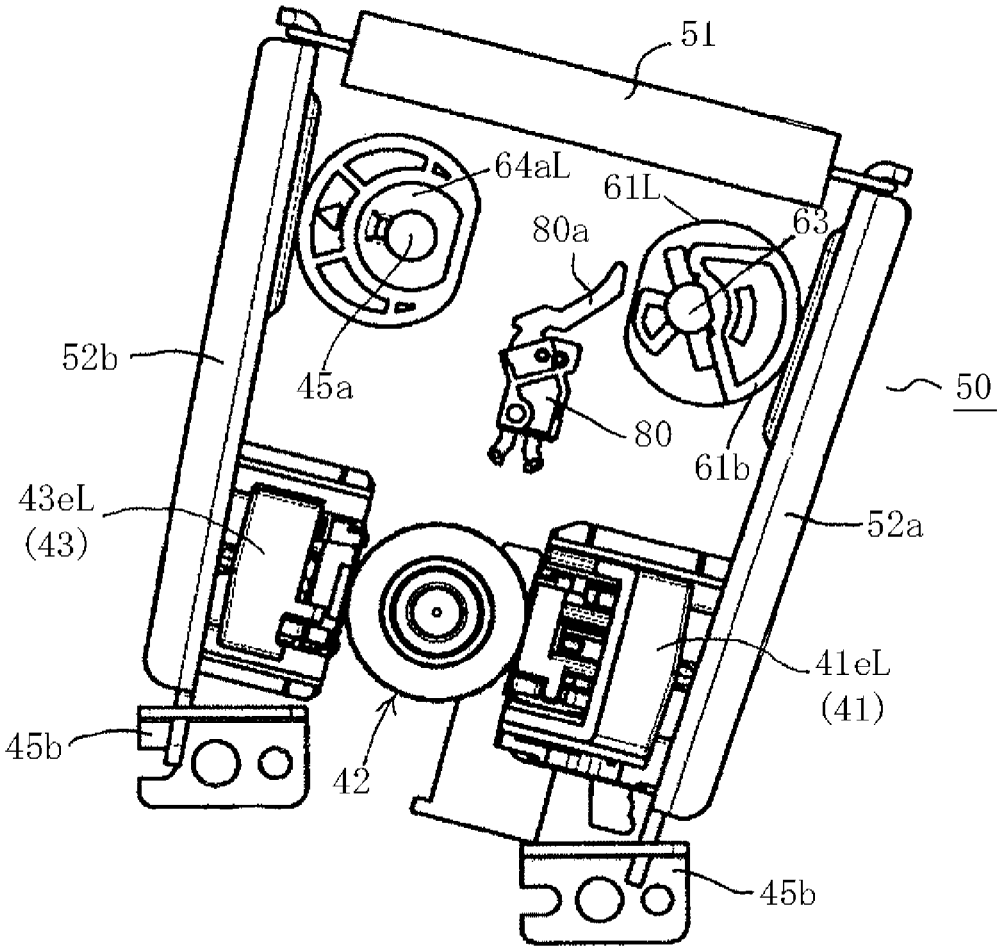
FIG. 7 is a schematic view showing the force imparting mechanism in a pressure-released state on one end side.

When the cams 61L, 61R and the cams 64*a*L, 64*a*R are rotated 180 degrees, maximum outer diameter portions of the cams act on the pressing plates 52*a*, 52*b*. At this point of time, the controller 100 stops the drive of the driving mechanism M2. FIG. 7 shows the above state of the fixing device 40 on one end side. This is true for also on the other end side. In this state, pressure importation from the pressing plates 52*a*, 52*b* to the heating unit 41 and the pressing unit 43 is eliminated and thus the heating unit 41 and the pressing unit 43 do not urge the fixing roller 42, so that a pressure-released state in which the pressures of the fixing nip P and the heating nip Q are released (eliminated) is formed. In this manner, the first gear portion (62L, 62R) and the second gear portion (64*b*L, 64*b*R) engage with each other, so that the driving force is transmitted from one gear portion to the other gear portion. As a result, it is possible to provide a constitution capable of effecting the pressure release of the two nips simultaneously or a constitution capable of effecting the pressure release of the two nips with a predetermined time difference.

In this embodiment, the pressure-release of the heating unit 41 and the pressure-release of the pressing unit 43 are effected simultaneously. The fixing nip P is a nip for effecting sheet feeding and is required to be pressure-released during ordinary jam clearance, and therefore is set so as to have a release amount larger than that of the heating nip Q.

The controller 100 drives the driving mechanism M2 again on the basis of a closing signal of a device door (not shown) after the jam clearance or a energy-saving mode eliminating signal. As a result, the large outer diameter sides of the cams 61L, 61R, 64*a*L, 64*a*R gradually move away from the associated pressing plates 52*a*, 52*b*. Then, when the cams 61L, 61R, 64*a*L, 64*a*R are rotated 180 degrees, the heating nip Q and the fixing nip P are restored from the pressure-released state of FIG. 7 to the pressed state of FIG. 5.

That is, the heating unit 41 and the pressing unit 43 return to the pressed state in which these units are pressed against the fixing roller 42. At this point of time, the controller 100 stops the drive of the driving mechanism M2.

Next, phase control of the pressure-releasing mechanism 60 will be described. The fixing device 40 is, as described above, capable of being put in the pressure-released state in which the cams 61L, 61R, 64*a*L, 64*a*R of the pressure-releasing mechanism 60 retract the pressing plates 52*a*, 52*b* from the heating unit 41 and the pressing unit 43 and in the pressed state in which the cams 61L, 61R, 64*a*L, 64*a*R do not cam the pressing plates 52*a*, 52*b*.

The controller 100 detects a stop position of the cam of the pressure-releasing mechanism 60 by a pressure release sensor 80 and then controls the driving mechanism M2 for driving the pressure-releasing mechanism 60. The pressure release sensor 80 is disposed outside the side plate 45L on one end side (non-driving side) and in the neighborhood of the cam 61L.

When the cam 61L rotates, a sensor action portion 61*b* of the cam 61L acts on a lever 80*a* of the sensor 80 (FIG. 5). The sensor action portion 61*b* of the cam 61L has a cam shape and varies in diameter from a rotation center with respect to a circumferential direction, so that the sensor action portion 61*b* changes a pressing amount thereof against the lever 80*a*.

When the sensor action portion 61*b* of the cam 61L presses the lever 80*a* of the sensor 80, the lever 80*a* is rotated. When the lever 80*a* is rotated, elements (not shown) in the sensor 80 cam each other, so that turning-on of the sensor 80 is detected. Further, when the pressing amount of the lever 80*a* decreases, the elements (not shown) are spaced from each other, so that the sensor state is switched to a turning-off state.

The controller 100 detects a phase of the cam 61L from timing when the turning-on and the turning-off of the sensor 80 are switched to each other and waits for a time until the cam 61L moves to a pressed position or a pressure-released position, and then provides a stop instruction to the driving mechanism M2. As a result, the phase of the cam is controlled.

In order to put the heating nip Q and the fixing nip P in the pressure-released state simultaneously, there is a need that the four cams 61L, 61R, 64*a*L, 64*a*R are in phase with each other. However, the cam subjected to rotational phase control by the sensor 80 is only the cam 61L on one end side of the fixing device 40 as described above. Therefore, the phase of the cam 61L subjected to the rotational phase control and phases of other three cams 61R, 64*a*L, 64*a*R are aligned with each other during assembling, so that the phases of all of the cams 61L, 61R, 64*a*L, 64*a*R are controlled by the sensor 80.

In the following, a phase-aligning method of the four cams 61L, 61R, 64*a*L, 64*a*R will be described. The cam 61L on one end side and the gears 62L, 62R on one end side and the other end side are configured so that they cannot be engaged with the pressure-releasing shaft 63 at a phase other than a phase determined by a D-cut shape provided to the pressure-releasing shaft 63. As a result, the phases of the cams 61L, 61R are controlled. The gears 64*a*L, 64*a*R as the other gear portion correspondingly engaging with the gears 62L, 62R as one gear portion have the same number of teeth as those of the gears 62L, 62R, and therefore when these gears are assembled at proper phases, the phases of these gears are not shifted. Each of the gears 62L, 62R, 64*b*L, 64*a*R is provided with a triangular hole 90. These gears are assembled so that adjacent triangular holes 90 are disposed opposed to each other, whereby the phases of these gears are aligned with each other. However, only by the use of the triangular holes 90, in the case where the gears are assembled at erroneous phases, the erroneous phase assembling cannot be detected.

Figure 8:
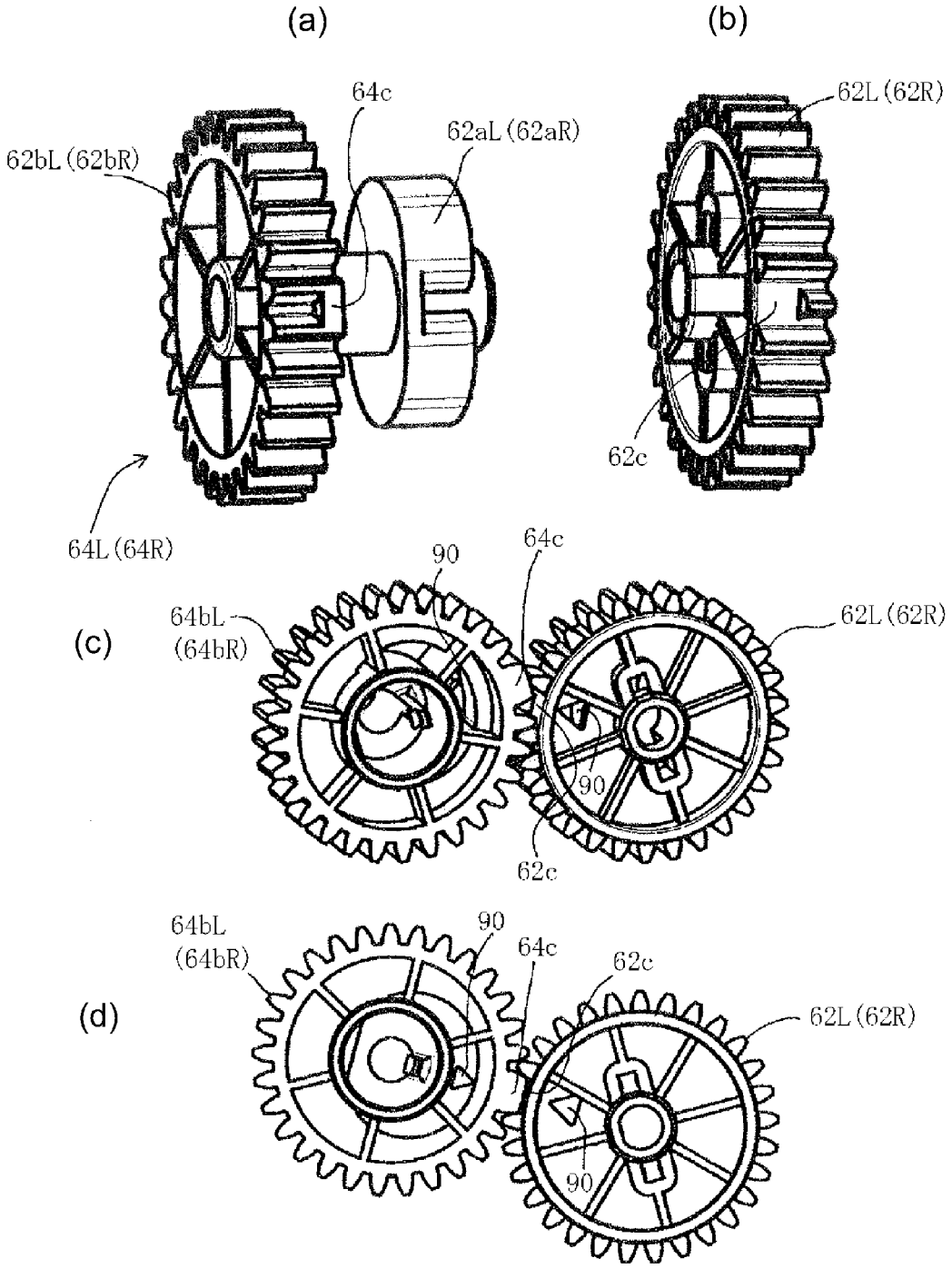
In FIG. 8, (a) to (d) are illustrations of a partly tooth-omitted portion of a gear portion and a tooth-burried portion of a gear portion.

As shown in (a) of FIG. 8, each of the gears 64*b*L, 64*b*R is provided with a position 64*c*, where a part between adjacent teeth of the gear portion with respect to a face width direction is filled, at one position. On the other hand, as shown in (b) of FIG. 8, each of the gears 62L, 62R is provided with a partly tooth-omitted portion 62*c* where a part of a single heat of the gear portion with respect to the face width direction is omitted. That is, of the first gear portions (62L, 62R) and the second gear portion (64*b*L, 64*b*R), at a part of one of the gear portions with respect to a circumferential direction, a recessed portion (partly tooth-omitted portion 62*c*) where a pitch between adjacent teeth is broader than a pitch between other adjacent teeth with respect to the circumferential direction of the one of the gear portions is provided, and at a part of the other gear portion with respect to the circumferential direction, a projected portion (tooth-burried portion 64*c*) capable of entering only the recessed portion with respect to the circumferential direction of the one of the gear portions is provided.

When the phases of the gears 64*b*L, 64*b*R and the phases of the gears 62L, 62R are not proper, as shown in (c) of FIG. 8, the tooth-burried portion 64*c* of the gear 64*b*L (64*b*R) and the tooth of the gear 62L (62R) interfere with each other, so that the gears cannot rotate. As shown in (d) of FIG. 8, only in the case where the gears are assembled at proper phases, the gear 64*b*L (64*b*R) and the gear 62L (62R) engage with each other and are rotatable. As a result, it is possible to prevent assembling at erroneous phases, so that the four cams 61L, 61R, 64*a*L, 64*a*R can be assembled while controlling the phases thereof.

Figure 1:
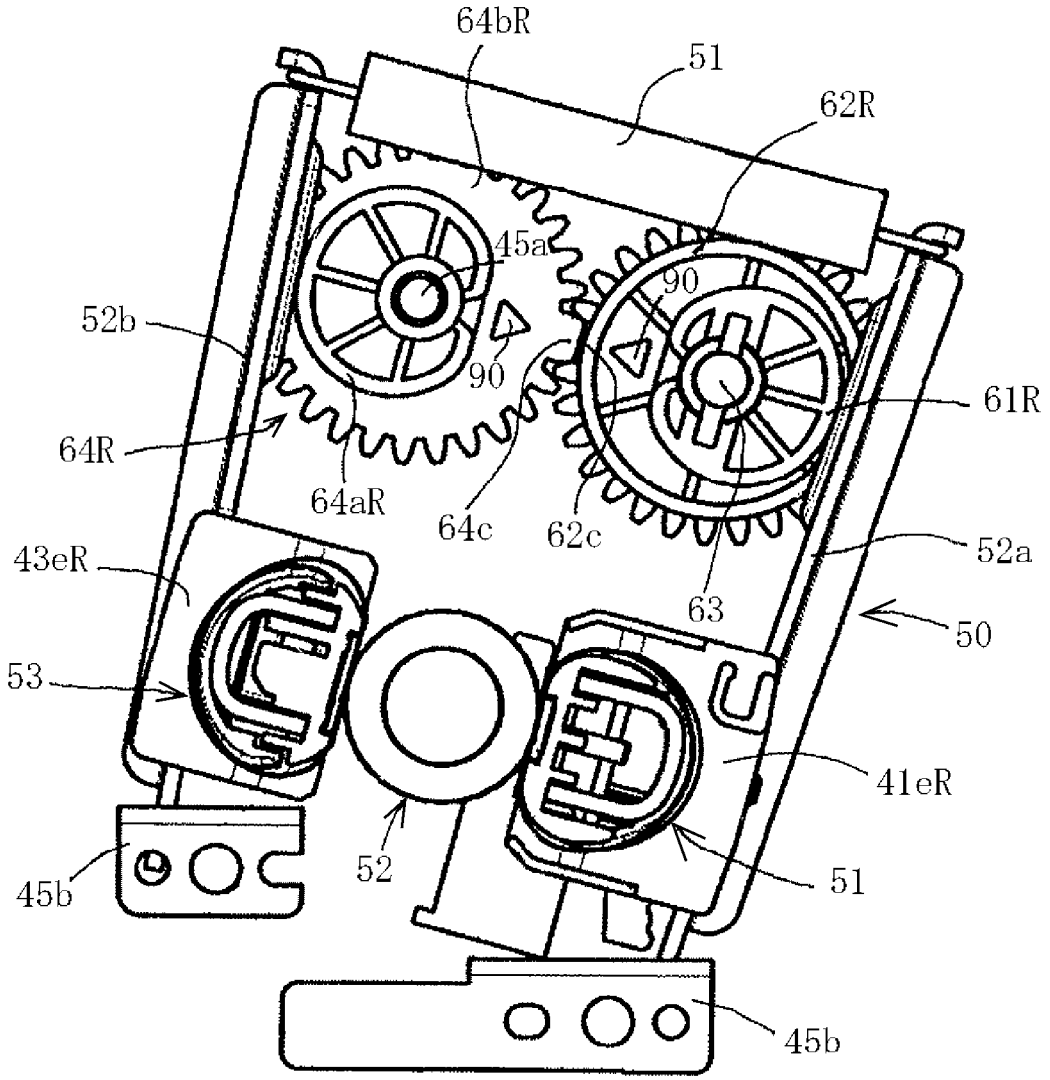
FIG. 1 is a schematic view showing a force imparting mechanism in a pressure-released state on the other end side.

In this embodiment, as shown in FIG. 1, the partly tooth-omitted portion 62*c* and the tooth-burried portion 64*c* are disposed so as to engage with each other when maximum outer diameter portions of the cam 61R and the cam 64*a*R are in a state (pressure-released state) in which the portions act on the pressing plates 52*a*, 52*b*, respectively. That is, the projected portion 64*c* enters the recessed portion 62*c* at a timing when the maximum outer diameter portions of the first and second cam portions act on the force imparting mechanism 50.

Embodiment 2

Figure 9:
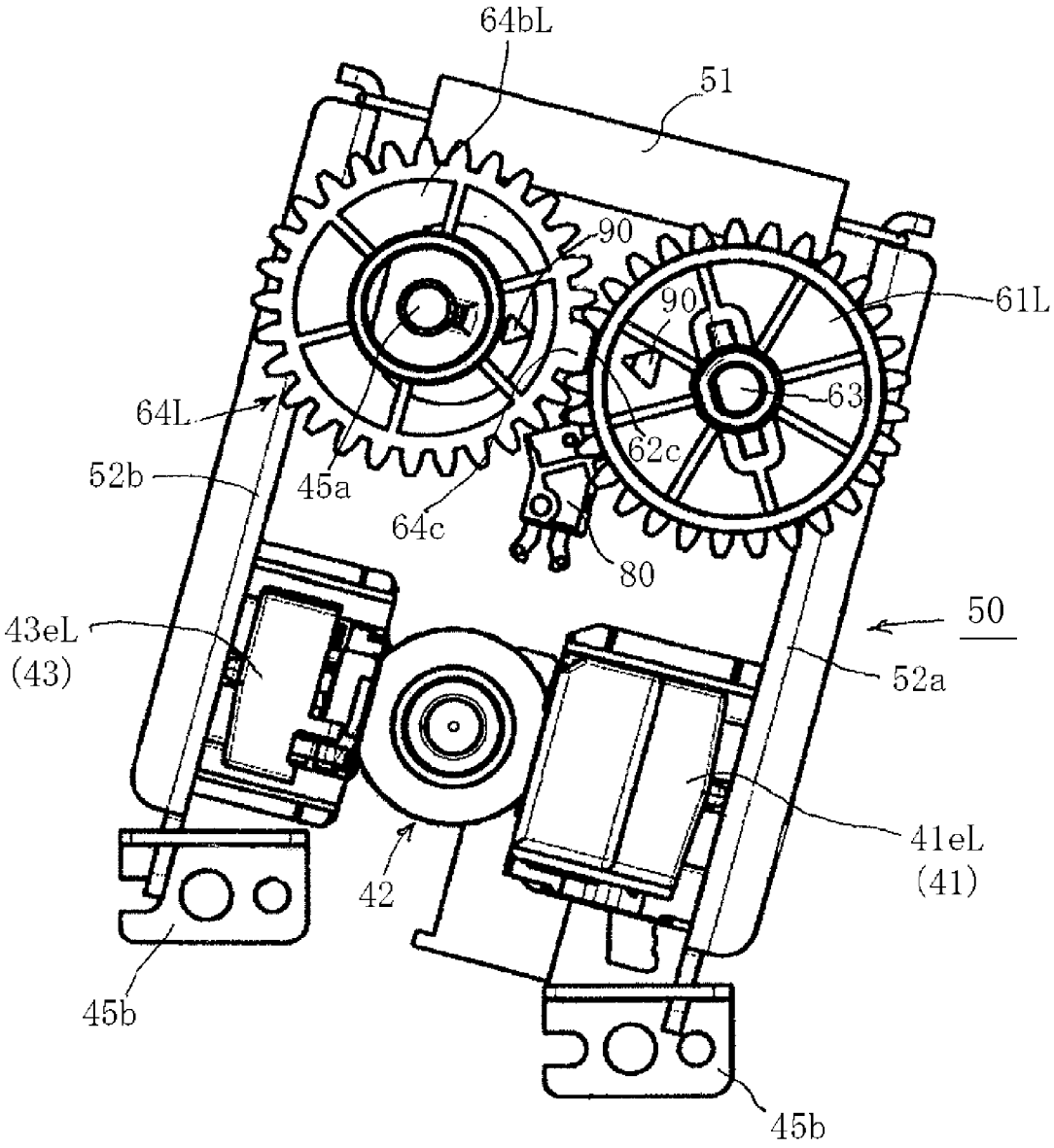
FIG. 9 is an illustration of a pressure-releasing mechanism in Embodiment 2.

In Embodiment 2, contrary to the case of Embodiment 1, as shown in FIG. 9, the partly tooth-omitted portion 62*c* and the tooth-burried portion 64*c* are disposed so as to engage with each other when the portions are in the pressed state. That is, the portions 62*c*, 64*c* are disposed so as to engage with each other in a state in which minimum outer diameter portions of the cams 61L, 61R, 64*a*L, 64*a*R are directed toward the pressing plates 52*a*, 52*b* (FIG. 5), i.e., in a state (pressed state) in which the cams do not act on the pressing plates 52*a*, 52*b*. In other words, the projected portion 64*c* enters the recessed portion 62*c* at timing when the first and second cam portions do not act on the force imparting mechanism 50.

Embodiment 3

Figure 10:
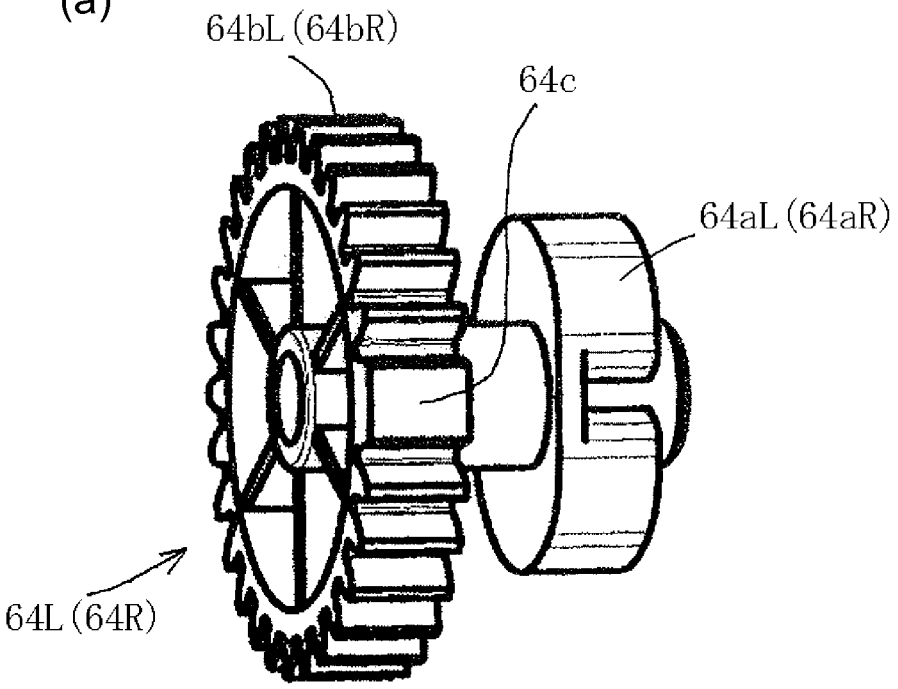
In FIG. 10, (a) is a perspective view of a cam gear in a pressure-releasing mechanism in Embodiment 3, and (b) is a perspective view of a gear in the pressure-releasing mechanism in Embodiment 3.
Figure 10:
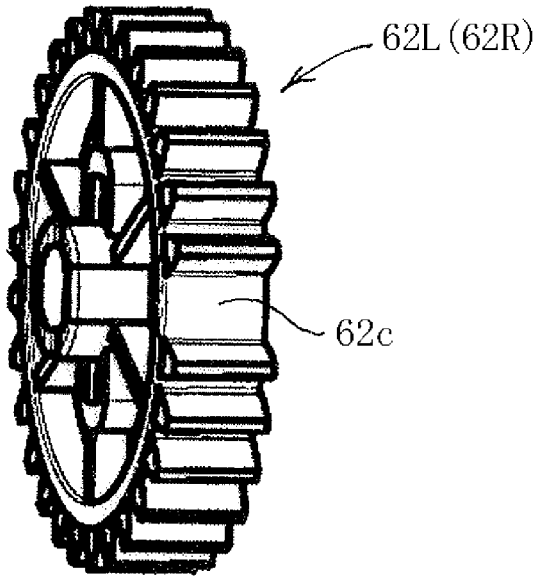

The partly tooth-omitted portion 62*c* of the gear 62L (62R) and the tooth-burried portion 64*c* of the gear 64*b*L (64*b*R) may also be provided over an entire region with respect to the face width direction as shown in (a) and (b) of FIG. 10. In the case where a positional variation between the gears can be made small or in the case where a drive load exerted on the gears is small, determination of the phases of the gears can be easily made with a small face width.

Next, using FIG. 11, a relationship between rotational phases of the cams 61L, 61R, 64*a*L, 64*a*R and drive loads exerted on engaging portions of the gears 62L, 62R, 64*b*L, 64*b*R (i.e., a relationship between the rotational phase of the pressure-releasing cam and the drive load) will be described.

Figure 11:
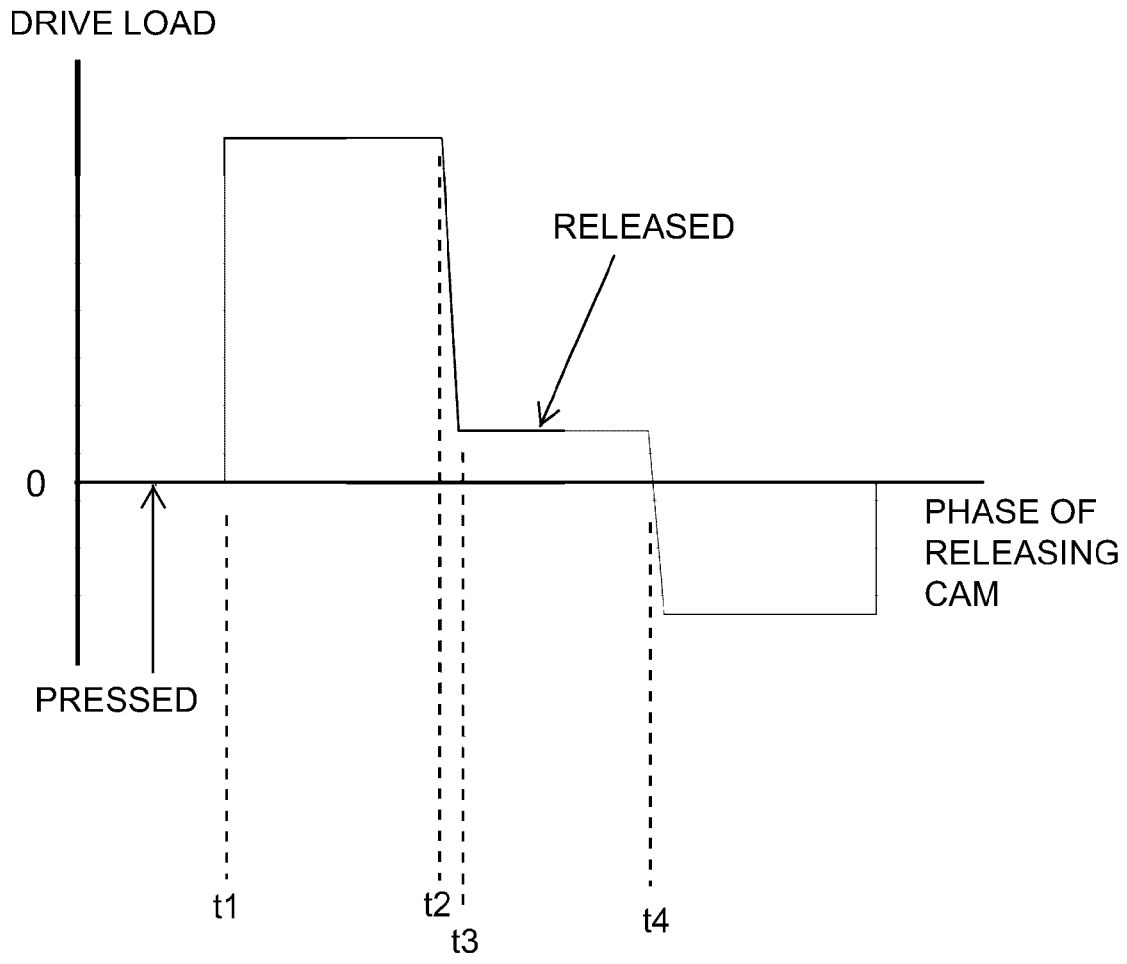
FIG. 11 is a graph showing a relationship between a rotational phase and a drive load of a pressure-releasing cam.

As shown in FIG. 11, in the pressed state (period from phase zero to phase M) in which the minimum outer diameter portions of the cams 61L, 61R, 63*a*L, 64*a*R are directed toward the pressing plates 52*a*, 52*b*, the cams 61L, 61R, 64*a*L, 64*a*R do not act on the pressing plates 52*a*, 52*b*. For that reason, the drive loads exerted on the engaging portions between the gears 62L, 62R, 64*b*L, 64*b*R are substantially zero.

When the cams 61L, 61R, 64*a*L, 64*a*R rotate, the cam portions gradually approach and contact the pressing plates 52*a*, 52*b*. When the cams further rotate, the outer diameters of the cams contacting the pressing plates 52*a*, 52*b* gradually increase, so that the cams gradually retract the pressing plates 52*a*, 52*b* against spring forces of the springs 51. The cams 61L, 61R, 64*a*L, 64*a*R retract the pressing plates 52*a*, 52*b* while extending an acting length of the springs 51, and therefore large drive loads are generated on the gears 62L, 62R, 64*b*L, 64*b*R (period from phase t1 to phase t2).

When the cams 61L, 61R, 64*a*L, 64*a*R further rotate, the pressure-released state in which the maximum outer diameter portions of the cams retract the pressing plates 52*a*, 52*b* is formed (phase t3). When the pressure-released state is formed, even when the cams 61L, 61R, 64*a*L, 64*a*R rotate, the acting length of the springs 51 does not change. For that reason, on the cams 61L, 61R, 64*a*L, 64*a*R and the gears 62L, 62R, 64*b*L, 64*b*R, only the drive loads due to frictional forces with the pressing plates 52*a*, 52*b* are generated, so that the drive loads decrease (period from phase t3 to phase t4).

When the cams 61L, 61R, 64*a*L, 64*a*R further rotate, the outer diameter portions thereof contacting the pressing plates 52*a*, 52*b* gradually decrease. The cams 61L, 61R, 64*a*L, 64*a*R receive forces for rotating the cams in advancing directions by the tension springs 51 and the pressing plates 52*a*, 52*b*, and therefore a relationship between the driving side and the driven side of the gear portions is opposite to the previous relationship, so that the drive loads exerted on the gear portions are negative (phase t4 and later).

Advantages of Fixing Device and Image Forming Apparatus According to Embodiments 1, 2 and 3

As described above, the gear portions 62L, 62R, 64*b*L, 64*b*R of the pressure-releasing mechanism 60 are provided with the partly tooth-omitted portions 62*c* and the tooth-burried portions 64*c* in order to assemble the gear portions with proper phases. In Embodiments 1 and 2, the partly tooth-omitted portion 62*c* and the tooth-burried portion 64*c* have an engaging portion where the face width is narrower than a normal face width. In Embodiment 3, the partly tooth-omitted portion 62*c* and the tooth-burried portion 64*c* have an engaging portion where an engaging ratio (degree) is smaller than a normal engaging ratio (degree).

On the engaging portions of the gears 62L, 62R, 64*b*L, 64*b*R, forces for retracting the pressing plate 52*a* by the cams 61L, 61R and forces for retracting the pressing plate 52*b* by the cams 64*a*L, 64*a*R are exerted.

Therefore, in each of Embodiments 1, 2 and 3, the gears are disposed so that the partly tooth-omitted portions 62*c* and the tooth-burried portions 64*c* engage with each other when the forces by which the cams 61L, 61R, 64*a*L, 64*a*R act on the pressing plates 52*a*, 52*b* are relatively small within the rotational phases of the cams (pressed state, pressure-released state). That is, the gears are disposed so that the partly tooth-omitted portions 62*c* and the tooth-burried portions 64*c* engage with each other at the time other than the time when the cams retract the pressing plates 52*a*, 52*b* in the pressure-releasing direction. That is, the projected portions 64*c* enter the recessed portions 62*c* at a timing other than the period (from phase t2 to phase t2) in which the heating unit 41 and the pressing unit 43 move away from the fixing roller 42 by the action of the first and second cam portions on the force imparting mechanism 50.

According to the fixing device 40 and the image forming apparatus 1 which are constituted as described above, it is possible to compatibly realize space saving, an assembling property and reliability.

Other Embodiments (1) In Embodiments 1, 2 and 3, a constitution in which the gears 64*b*L, 64*b*R are provided with the "partly tooth-omitted portion" and the gears 62L, 62R are provided with the "tooth-burried portion" may also be employed.

(2) The transmission of the driving force from the external driving mechanism M2 to the pressure-releasing mechanism 60 is not limited to the transmission to the gear 62R in Embodiments 1 to 3. A constitution of transmission to either one of the gear portions 62L, 64*b*R, 64*b*L and another transmission constitution may also be employed.

(3) The heating unit 41 is not limited to those in the constitutions of Embodiments 1 to 3. The constitution may also be changed to those of a heat roller type or another type. Also the pressing unit 43 is not limited to those in the constitutions of Embodiments 1 to 3. The constitutions may also be changed to those of a pressing roller type or another type.

(4) In the above, as the fixing device according to the present invention, the fixing device for heating and fixing the unfixed toner image formed on the recording material (sheet) was described as an example, but the following device is also similarly applicable. For example, to a device for increasing a gloss (glossiness) of an image by heating and re-fixing a toner image temporarily fixed on a sheet (also in this case, the device is referred to as the fixing device), the present invention is also applicable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-108318 filed on May 28, 2015, which is hereby incorporated by reference herein in its entirety.

What is claimed is:

1. A fixing device comprising:

a fixing roller;

a heating unit for forming a heating nip in cooperation with said fixing roller;

a pressing unit for forming a fixing nip in cooperation with said fixing roller;

a force imparting mechanism for imparting a force to said heating unit and said pressing unit in directions of sandwiching said fixing roller;

a first pressure releasing mechanism including a first cam portion actable on said force imparting mechanism in a direction of spacing said heating unit from said fixing roller and including a first gear portion for driving said first cam portion; and a second pressure releasing mechanism including a second cam portion actable on said force imparting mechanism in a direction of spacing said pressing unit from said fixing roller and including a second gear portion for driving said second cam portion, wherein said first gear portion and said second gear portion engage with each other, and a driving force is transmitted from one gear portion of said first and second gear portions to the other gear portion of said first and second gear portions.

2. A fixing device according to claim 1, wherein a part of one of said first and second gear portions with respect to a circumferential direction is provided with a recessed portion where a pitch between adjacent teeth is broader than another pitch with respect to the circumferential direction of said one of said first and second gear portions, and a part of the other of said first and second gear portions with respect to the circumferential direction is provided with a projected portion capable of entering only the recessed portion of said one of said first and second gear portions with respect to the circumferential direction.

3. A fixing device according to claim 2, wherein the projected portion enters the recessed portion at a timing other than a period in which said heating unit and said pressing unit move in a direction of being spaced from said fixing roller by action of said first and second cam portions on said force imparting mechanism.

4. A fixing device according to claim 2, wherein the projected portion enters the recessed portion at a timing when maximum outer diameter portions of said first and second cam portions act on said force imparting mechanism.

5. A fixing device according to claim 2, wherein the projected portion enters the recessed portion at a timing when said first and second cam portions do not act on said force imparting mechanism.

6. A fixing device according to claim 1, wherein said heating unit includes a cylindrical film contacting said fixing roller and a heater, contacting an inner surface of said film, for forming the heating nip between said film and said fixing roller in cooperation with said fixing roller.

7. A fixing device according to claim 1, wherein said pressing unit includes a cylindrical film contacting said fixing roller and a sliding member, contacting an inner surface of said film, for forming the fixing nip between said film and said fixing roller in cooperation with said fixing roller.

* * * * *